US010373628B2

(12) United States Patent
Taniguchi et al.

(10) Patent No.: US 10,373,628 B2
(45) Date of Patent: Aug. 6, 2019

(54) SIGNAL PROCESSING SYSTEM, SIGNAL PROCESSING METHOD, AND COMPUTER PROGRAM PRODUCT

(71) Applicant: Kabushiki Kaisha Toshiba, Minato-ku, Tokyo (JP)

(72) Inventors: Toru Taniguchi, Yokohama Kanagawa (JP); Taro Masuda, Kawasaki Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 213 days.

(21) Appl. No.: 15/433,336

(22) Filed: Feb. 15, 2017

(65) Prior Publication Data

US 2018/0061432 A1 Mar. 1, 2018

(30) Foreign Application Priority Data

Aug. 31, 2016 (JP) ..... 2016-169999

(51) Int. Cl.
*G10L 21/028* (2013.01)
*H04R 1/40* (2006.01)
(Continued)

(52) U.S. Cl.
CPC ..... *G10L 21/028* (2013.01); *G10L 21/0272* (2013.01); *H04R 1/406* (2013.01); *G10L 21/0232* (2013.01)

(58) Field of Classification Search
CPC ..... G10L 21/028; G10L 21/0272; G10L 21/0232; H04S 3/02; H04R 1/406
(Continued)

(56) References Cited

U.S. PATENT DOCUMENTS

2013/0010968 A1* 1/2013 Yagi ..... G10L 21/028 381/17
2014/0058736 A1 2/2014 Taniguchi et al.
(Continued)

FOREIGN PATENT DOCUMENTS

JP 4724054 7/2011
JP 4928382 5/2012
(Continued)

OTHER PUBLICATIONS

Lee et al., "Learning the Parts of Objects by Non-Negative Matrix Factorization," Nature, vol. 401, Oct. 21, 1999, www.nature.com., in 4 pages.

(Continued)

*Primary Examiner* — William A Jerez Lora
(74) *Attorney, Agent, or Firm* — Knobbe, Martens, Olson & Bear, LLP

(57) ABSTRACT

A signal processing system includes a filter unit, a conversion unit, a decomposition unit, and an estimation unit. The filter unit applies, to a plurality of time series input signals, N filters estimated by independent component analysis of the input signals to output N output signals. The conversion unit converts the output signals into nonnegative signals each taking on a nonnegative value. The decomposition unit decomposes the nonnegative signals into a spatial basis that includes nonnegative three-dimensional elements, that is, K first elements, N second elements, and I third elements, a spectral basis matrix of I rows and L columns that includes L nonnegative spectral basis vectors expressed by I-dimensional column vectors, and a nonnegative L-dimensional activity vector. The estimation unit estimates sound source signals representing signals of the signal sources based on the output signals using the spatial basis, the spectral basis matrix, and the activity vector.

10 Claims, 5 Drawing Sheets

(51) Int. Cl.
*G10L 21/0272* (2013.01)
*G10L 21/0232* (2013.01)

(58) Field of Classification Search
USPC ..... 381/20, 56, 58, 92
See application file for complete search history.

(56) References Cited

U.S. PATENT DOCUMENTS

| | | | | |
|---|---|---|---|---|
| 2014/0321653 | A1 | 10/2014 | Mitsufuji | |
| 2015/0139445 | A1* | 5/2015 | Kitazawa | G10L 21/0208 381/94.1 |
| 2015/0242180 | A1* | 8/2015 | Boulanger-Lewandowski | G06N 3/0445 700/94 |

FOREIGN PATENT DOCUMENTS

| | | |
|---|---|---|
| JP | 2014-041308 | 3/2014 |
| JP | 5520883 | 6/2014 |
| JP | 2014-215461 | 11/2014 |

OTHER PUBLICATIONS

Takahashi et al., "Blind Spatial Subtraction Array for Speech Enhancement in Noisy Environment," IEEE Transactions on Audio, Speech, and Language Processing, vol. 17, No. 4, May 2009 in 15 pages.

Togami et al., "Acoustic Echo Suppressor with Multichannel Semi-Blind Non-Negative Matrix Factorization," Proceedings of the Second APSIPA Annual Summit and Conference, Biopolis, Singapore, Dec. 14-17, 2010, pp. 522-525 in 4 pages.

Ephraim et al., "Speech Enhancement Using a Minimum Mean-Square Error Short-Time Spectral Amplitude Estimator," IEEE Transaction on Acoustics, Speech, and Signal Processing, vol. ASSP-32, No. 6, Dec. 1984 in 13 pages.

Hioka et al., "Underdetermined Sound Source Separation Using Power Spectrum Density Estimated by Combination of Directivity Gain, "IEEE Transactions on Audio, Speech, and Language Processing, vol. 21, No. 6, Jun. 2013 in 11 pages.

Lee et al., "Learning the Parts of Objects by Non-Negative Matric Factorization," Nature, vol. 401, Oct. 21, 1999, www.nature.com., in 4 pages.

Lee et al., "Beamspace-Domain Multichannel Nonnegative Matrix Factorization for Audio Source Separation," IEEE Signal Processing Letters, vol. 19, No. 1, Jan. 2012 in 4 pages.

Murase sum et al., "Diffusion Noise Suppression using Transfer Function Gain Base NMF with the Non-Synchronous Dispersal Microphone Array," Acoustical Society of Japan Lecture Memoirs, Mar. 2015 in 12 pages.

Nakano et al., "Convergence-Guaranteed Multiplicative Algorithms for Nonnegative Matrix Factorization with β—Divergence," 2010 IEEE International Workshop on Machine Learning for Signal Processing (MLSP 2010), Kittilä, Finland, Aug. 29-Sep. 1, 2010 6 pages.

Shogo et al., "Underdetermine Stereo Channel Sound Source Separation Using the Non-Negative Value Tensor Factor Cracking," Acoustical Society of Japan Lecture memoirs, Mar. 2016 in 10 pages.

Takashi et al., "Blind Spatial Subtraction Array for Speech Enhancement in Noisy Environment," IEEE Transactions on Audio, Speech, and Language Processing, vol. 17, No. 4, May 2009 in 15 pages.

Togami et al., "Acoustic Echo suppressor with Multichannel Semi-Blind Non-Negative Matric Factorization," Proceedings of the Second APSIPA Annual Summit and Conference, Biopolis, Singapore, Dec. 14-17, 2010, pp. 522-525 in 4 pages.

* cited by examiner

SIGNAL PROCESSING SYSTEM, SIGNAL PROCESSING METHOD, AND COMPUTER PROGRAM PRODUCT

CROSS-REFERENCE TO RELATED APPLICATIONS

This application is based upon and claims the benefit of priority from Japanese Patent Application No. 2016-169999, filed on Aug. 31, 2016; the entire contents of which are incorporated herein by reference.

FIELD

Embodiments described herein relate generally to a signal processing system, a signal processing method, and a computer program product.

BACKGROUND

Under circumstances where a microphone is away from sound sources, when a plurality of sound sources are present, consideration is given to collecting sounds for individual sound sources in high quality. The microphone observes signals coming from the sound sources mixed in a space. For this reason, it is desirable that the signals be separated for each sound source, or that sound capture be performed while suppressing signals coming from other sound sources (noise sources) when a single sound source is targeted. To this end, signal processing techniques have been proposed to enhance a target speech using multichannel acoustic signals obtained by a microphone array, that is, a plurality of microphones.

In the conventional techniques, a variation in acoustic characteristics of a space, a deviation from an expected arrangement or sensitivity of microphones, and other factors, have decreased the accuracy of estimating the sound source in some cases.

DETAILED DESCRIPTION

Figure 1:
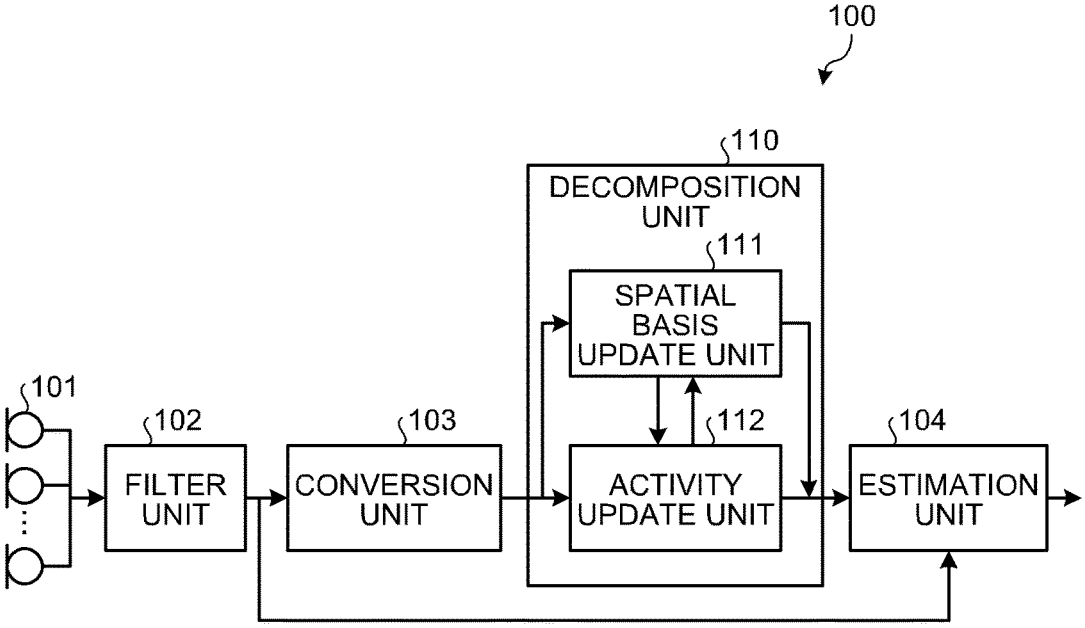
FIG. 1 is a block diagram of a signal processing system according to a first embodiment.

According to one embodiment, a signal processing system includes a filter unit, a conversion unit, a decomposition unit, and an estimation unit. The filter unit applies, to a plurality of time series input signals, N filters estimated by independent component analysis of the input signals to output N output signals. The conversion unit converts the output signals into nonnegative signals each taking on a nonnegative value. The decomposition unit decomposes the nonnegative signals into a spatial basis that includes nonnegative three-dimensional elements, that is, K first elements, N second elements, and I third elements, a spectral basis matrix of I rows and L columns that includes L nonnegative spectral basis vectors expressed by I-dimensional column vectors, and a nonnegative L-dimensional activity vector. The estimation unit estimates sound source signals representing signals of the signal sources based on the output signals using the spatial basis, the spectral basis matrix, and the activity vector.

Exemplary embodiments of a signal processing system according to the present invention are described below in detail with reference to the accompanying drawings.

First Embodiment

Techniques have been proposed for estimating a sound source signal in a particular direction (region) on the basis of output of a plurality of linear spatial filters. Such techniques estimate a sound source signal in a particular direction by modeling power spectral density of a plurality of output signals of linear spatial filters as the product of power spectral density of sound source signals in respective directions (regions) and a gain matrix prepared in advance, and multiplying a (pseudo) inverse matrix of the gain matrix by output vectors of the respective linear spatial filters, for example. In doing so, the gain matrix is calculated in advance from spatial arrangement of microphones and parameters of the linear spatial filters. As described above, a variation in acoustic characteristics of a space and other factors may cause variance between a previously expected environment and an actual environment of observation signals, deteriorating the quality of estimated results.

Although a signal processing system according to the first embodiment does not make assumptions in advance as described above, it estimates simultaneously, from observation signals themselves, information equivalent to a gain matrix and parameters of the observation signals instead. Thus, sound source estimation of higher quality than ever before is possible. In the present embodiment, model parameters for processing are adaptively estimated based on input while utilizing spatial information obtained from output of multichannel signal processing and observation signals. First, a plurality of output signals of multichannel signal processing are obtained so as to be separated for individual sound sources as much as possible by means of blind sound source separation, for example. A problem of sound source separation is then formulated as a problem of nonnegative tensor (matrix) factorization (NTF (NMF)) when the amplitude or power spectrum of the multichannel output signals is viewed as second-order or third-order tensor (matrix). The result of the factorization is used to constitute a noise suppression filter.

In the following embodiments, an example is described in which a sound source serves as a signal source and an acoustic signal (sound source signal) generated from the sound source serves as a signal source signal. The signal source and the signal source signal are not limited to a sound source and a sound source signal, respectively. Other signals (such as a brain wave signal and a radio wave signal) having a space propagation model similar to that of an acoustic signal may be applied as time series input signals, which are series of data points indexed in time order.

FIG. 1 is a block diagram illustrating an exemplary configuration of a signal processing system 100 according to the first embodiment. As illustrated FIG. 1, the signal processing system 100 includes a microphone array 101, a filter unit 102, a conversion unit 103, a decomposition unit 110, and an estimation unit 104.

The microphone array 101 includes a plurality of microphones (sensors). Each microphone (detection unit) detects a sound source signal from a sound source. The microphone array 101 can observe acoustic signals at a plurality of points in a space. The acoustic signals observed at the respective points, even at the same time, differ from one another depending on the location of the sound source and acoustic characteristics of the space. Proper use of the difference between these acoustic signals realizes spatial filters. Signals acquired by the microphone array 101 are sometimes referred to as observation signals.

The filter unit 102 applies N (where N is an integer of 2 or greater) linear spatial filters having spatial characteristics different from one another to two or more observation signals observed using the microphone array 101, and outputs N output signals (spatial filter output signals). N linear spatial filters are also referred to as a spatial filter bank. Observation signals input to the filter unit 102 correspond to a plurality of time series input signals. If the signal source signal is a sound source signal, the observation signals observed using the microphone array 101 correspond to the time series input signal. If the signal source signal is other signal such as a brain wave signal and a radio wave signal, the observation signals observed using a sensor that detects the other signal correspond to the time series input signal. As described later, a proper combination of linear spatial filters can improve the final accuracy of estimating the sound source.

The conversion unit 103 converts each output signal output from the filter unit 102 into a nonnegative signal taking on a nonnegative value. For example, the conversion unit 103 converts each output signal output from the filter unit 102 into a frequency domain signal by performing frequency analysis on the output signal. Furthermore, the conversion unit 103 converts a value of each frequency domain signal into a nonnegative value by taking an absolute value or a square of the absolute value for each time. The conversion unit 103 outputs N nonnegative signals thus obtained.

Any conventionally known method of frequency analysis can be applied such as Fourier analysis, filter bank analysis, and wavelet analysis. When the filter unit 102 applies linear spatial filters in a frequency domain, once the filter unit 102 directly inputs frequency domain signals to the conversion unit 103, the conversion unit 103 is not required to perform frequency analysis on the signals. Additionally, when observation signals are mixed based on an instantaneous mixing process in the frequency domain and are observed by microphones, the conversion unit 103 is not required to convert the observation signals into frequency domain signals.

The decomposition unit 110 decomposes each nonnegative signal into a spatial basis matrix and an activity vector (activity vector 1) using the NMF method. The spatial basis matrix is a matrix that includes nonnegative two-dimensional elements, that is, K (where K is an integer of 2 or greater according to the number of sound sources) elements (the first element) and N elements (the second elements). The activity vector is a nonnegative K-dimensional vector.

The decomposition unit 110 includes a spatial basis update unit 111 and an activity update unit 112. The spatial basis update unit 111 updates the spatial basis matrix with reference to its corresponding nonnegative signal and activity vector. The activity update unit 112 updates the activity vector with reference to its corresponding nonnegative signal and spatial basis matrix. The decomposition unit 110 repeats such update processing in order to improve the accuracy of decomposition.

The estimation unit 104 estimates a sound source signal on the basis of the output signal output from the filter unit 102 using the spatial basis matrix and the activity vector, and outputs the estimated signal (estimated sound source signal).

The units described above (the filter unit 102, the conversion unit 103, the decomposition unit 110, and the estimation unit 104) may be implemented by causing one or more processors such as a central processing unit (CPU) to execute a computer program, that is, via software, may be implemented via hardware such as one or more integrated circuits (IC), or may be implemented by combining both software and hardware.

Figure 2:
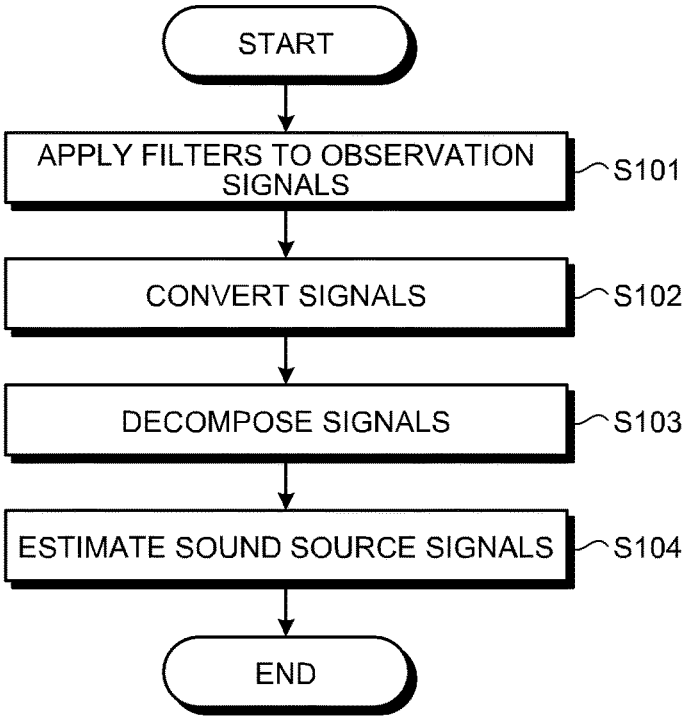
FIG. 2 is a flowchart of signal processing in the first embodiment.

The following describes signal processing performed by the signal processing system 100 thus configured according to the first embodiment with reference to FIG. 2. FIG. 2 is a flowchart illustrating exemplary signal processing in the first embodiment.

The filter unit 102 applies N linear spatial filters to the observation signals (input signals) observed by the microphone array 101, and outputs N output signals (Step S101). The conversion unit 103 converts the output signals into nonnegative signals (Step S102). The decomposition unit 110 decomposes the nonnegative signals into a spatial basis matrix and an activity vector (Step S103). The estimation unit 104 estimates sound source signals on the basis of the output signals using the spatial basis matrix and the activity vector, and outputs the estimated sound source signals (Step S104).

Observation and Decomposition Models in Power Spectral Domain Using Spatial Filter Bank The following further describes details of the present embodiment. Models for observing and decomposing signals using a spatial filter bank are first described. A spatial filter bank assumes observation signals observed by a plurality of microphones to be input, and outputs respective output signals from a plurality of linear spatial filters. Here, an observation model is considered for observing mixed signals through the spatial filter bank system.

The model observes, using M microphone(s), acoustic signals coming from a sound source(s) k ($1 \le k \le K$) in a direction $\theta_k$ viewed from the microphone(s) in a space. This system is considered as a linear time-invariant system. When an impulse response between the sound source and the microphone is sufficiently shorter than the window length in which short-time Fourier transform (STFT) is performed, short-time Fourier transform is performed on observation signals. When a frequency i is $1 \le i \le I$ (where I is an integer of 2 or greater) and a time j is $1 \le j \le J$, the relation between a sound source signal $s_{ijk}$ and an observation signal $x_{ijk}$ can be represented by expression (1).

$$x_{ijk} = a_i(\theta_k) s_{ijk} \tag{1}$$

Let $a_i(\theta_k)$ represent a steering vector in the direction $\theta_k$. The sound source signal $s_{ijk}$ is expressed by a complex number, and the observation signal $x_{ijk}$ and $a_i(\theta_k)$ are each expressed by an M-dimensional complex number. The steering vector is uniquely determined between the sound source and the microphone array 101.

To simplify the description here, the steering vector is determined only by the direction $\theta_k$ viewed from the microphone array 101. In fact, the steering vector varies depending on various spatial factors, such as the distance between the microphone array 101 and the sound source, and the location of the microphone array 101 in a room, even if the same microphone array 101 is used.

Furthermore, when K sound sources are present, the observation signal $x_{ij}$ can be simply represented by the sum of observation signals from the respective sound sources, as shown in expression (2) below. Note that $x_{ij}$ is expressed by an M-dimensional complex number.

$$x_{ij} = \sum_{k=1}^{K} a_i(\theta_k) s_{ijk} \tag{2}$$

The observation signal $x_{ij}$ can also be represented in a matrix form as shown in expression (3) below.

$$x_{ij}=A_i s_{ij} \tag{3}$$

$A_i$ is a mixing matrix expressed by an M×K-dimensional complex number and defined as expression (4) below. $s_{ij}$ is a sound source vector expressed by a K-dimensional complex number and defined as expression (5) below. "t" on the right side of expression (5) denotes the transpose of the matrix.

$$A_i a_i(\theta_1) \ldots a_i(\theta_k) \ldots a_i(\theta_K)] \tag{4}$$

$$s_{ij} s_{ij1} \ldots s_{ijk} \ldots s_{ijk}]^t \tag{5}$$

It is now considered to obtain N output signals by applying N spatial filters to the observation signal. When output signals are expressed by an N-dimensional vector $y_{ij}$, an output signal $y_{ij}$ can be represented as expression (6) below using a separation matrix $W_i$ representing the N spatial filters. The separation matrix $W_i$ is expressed by an N×M-dimensional complex number. A spatial filter group expressed by the separation matrix $W_i$ is sometimes referred to as a spatial filter bank $W_i$.

$$y_{ij}=W_i A_i s_{ij} \tag{6}$$

It is considered that the observation signal $x_{ij}=A_i s_{ij}$ is filtered by the spatial filter group $W_i$ (spatial filter bank) having N spatial characteristics different from one another to be analyzed into N output signals.

Here, considering a matrix $G_i$ that is defined as $G_i=W_i A_i$ and expressed by a N×K-dimensional complex number, the output signal $y_{ij}$ can further be represented as expression (7) below. The output signal $y_{ij}$ corresponds to the N output signals output by the filter unit 102.

$$y_{ij}=G_i s_{ij} \tag{7}$$

Granted that the steering vector $a_i(\theta_k)$ in each direction can be accurately known in advance, $G_i$ is known, which enables $s_{ij}$ to be determined from $y_{ij}$. In fact, the assumed direction $\theta_k$ cannot be known in advance. Even if $\theta_k$ is known, a gap is found between the theoretical value and the actual value of the steering vector $a_i(\theta_k)$. That is, the steering vector $a_i(\theta_k)$ is difficult to be accurately estimated.

Here, the problem is considered in a power domain. Where the n-th ($1 \le n \le N$) element of $y_{ij}$, $y_{ijn}=\{y_{ij}\}_n$, is concerned, it can be represented as expression (8) below using an element in n-th row and k-th column of $G_i$, $\{G_i\}_{nk}$.

$$y_{ijn} = \sum_{k=1}^{K} \{G_i\}_{nk} s_{ijk} \tag{8}$$

Granted that sound sources have no correlation with one another, the element can be approximated as shown in expression (9) below by taking a square of an absolute value of each term.

$$|y_{ijn}|^2 \approx \sum_{k=1}^{K} |\{G_i\}_{nk}|^2 |s_{ijk}|^2 \tag{9}$$

Thus, assuming that a square of an absolute value of each element for a matrix B is expressed as $|B|^2$, expression (7) can be approximated by a power domain as shown in expression (10). The conversion unit 103 converts output signals into nonnegative signals by applying the left side of expression (10), for example.

$$|y_{ij}|^2 \approx |G_i|^2 |s_{ij}|^2 \tag{10}$$

Similarly to expression (7), if $|G_i|^2$ is known, it is possible to estimate a power spectral density (PSD) vector $|s_{ij}|^2$ of a sound source.

In the local PSD estimation method or the method disclosed in Japanese Patent No. 4724054, instead of the direction $\theta_k$, a local space $R(\theta_k)=[\theta_k-\delta, \theta_k+\delta]$ is defined that has an angle width with the direction $\theta_k$ as a center, and the average power spectral density is considered for each local space. This average power spectral density is substituted by $G_i$ that is represented by expression (11) below.

$$|\{G_i\}_{kn}|^2 = E[|w_{ni}^h a_i(\theta)|^2]_{\theta \in R(\theta_k)} \tag{11}$$

$E[\cdot]$ denotes an expectation operation. $w^h_{ni}$ is a vector in the n-th row of the separation matrix $W_i$. The symbol h denotes the Hermitian transpose of the matrix. In this manner, expression (10) can be used to estimate the PSD of a sound source in a local space having a certain range, instead of a specific point the location of which is difficult to be specified. With a local space having a certain range, estimating the location of a target sound source in advance in accordance with an application is also a realistic assumption.

In order to calculate $|\{G\}_{kn}|^2$ in advance, the steering vector $a_i(\theta)$ needs to be determined as shown in expression (11). However, the steering vector varies depending on acoustic characteristics of a space affected by a room or a place used and a deviation from an expected arrangement or sensitivity of microphones, as described above. Consequently, the quality of sound source estimation may be deteriorated.

For this reason, the present embodiment enables accurate estimation of sound sources independently of the accuracy of $|\{G\}_{kn}|^2$ by considering the problem of estimating a sound source PSD (power) as an NMF problem in the model shown in expression (10). Hereinafter, an operator $|\cdot|^2$ for the square of the absolute value of each element in a matrix is omitted for simplicity unless specifically mentioned.

Derivation of Multichannel Post Filter

It has been discussed that observation signals can be represented by the decomposition model as shown in expression (10) in the power spectral domain using a spatial filter bank. The following recites that this problem can be solved as an NMF problem.

First, the problem of expression (10) is described as a problem of NMF at each frequency. Expression (12) below is rewritten with the operator $|\cdot|^2$ omitted from expression (10).

$$y_{ij} \approx G_i s_{ij} \tag{12}$$

In the method of local PSD estimation, $G_i$ is given in advance. $a_i(\theta)$ in expression (11) needs to be calculated for each direction on the basis of information on microphone arrangement, for example, and $w^h_{ni}$ needs to be preset using some sort of criteria. Then, $s_{ij}$ is calculated from $y_{ij}$ using a (pseudo) inverse matrix of $G_i$. In doing so, the element of $s_{ij}$ becomes negative in some cases, which requires correction such as changing the relevant term to zero.

Because the elements in matrices on both sides of expression (12) are all nonnegative, this problem can be considered as a typical NMF problem. NMF is a problem of decomposing the left side in which all values are nonnegative into two matrices on the right side in which all values are nonnegative likewise. Assuming that matrices each having the vectors $y_{ij}$ and $s_{ij}$ as j column are respectively $Y_i$ and $S_i$, the problem can be represented as expression (13) below and considered as a NMF problem. $Y_i$ is expressed by a nonnegative N×J-dimensional real number. $S_i$ is expressed by a nonnegative K×J-dimensional real number.

$$Y_i \approx G_i S_i \tag{13}$$

Thus, $G_i$ may also be unknown, and $G_i$ and $s_{ij}$ can be estimated simultaneously. As described above, the method of the present embodiment can be applied even if microphone arrangement is unknown.

At this time, k column of $G_i$ corresponds to an output pattern when only signals from the sound source(s) k are passed through the spatial filter bank, that is, a power ratio between outputs of respective spatial filters. As is evident from expression (12), the power ratio is constant regardless of the power (the sound source signal $s_{ijk}$) of the corresponding sound source k. Furthermore, if the spatial filter bank is properly set, the pattern is such that the power ratio differs greatly for each of the sound sources k. The matrix $Y_i$ on the left side serves to extract K different patterns that consistently appear for j column into each column of the matrix $G_i$. Thus, applying NMF to expression (13) should cause a pattern having the power ratio for each sound source between outputs of respective spatial filters of the bank described above to be output for each sound source.

Here, the PSD pattern that appears in each column of $G_i$ is called a spatial basis vector, following the spectral basis vector used for applying NMF to decompose a spectrogram of one channel signal. Additionally, $G_i$ in which spatial basis vectors are arranged is called a spatial basis matrix. Although each element of $s_{ij}$ corresponds to the power of each sound source, it has arbitrariness of a value with $G_i$. For this reason, $s_{ij}$ is called an activity vector, following the conventional term of NMF.

Figure 3:
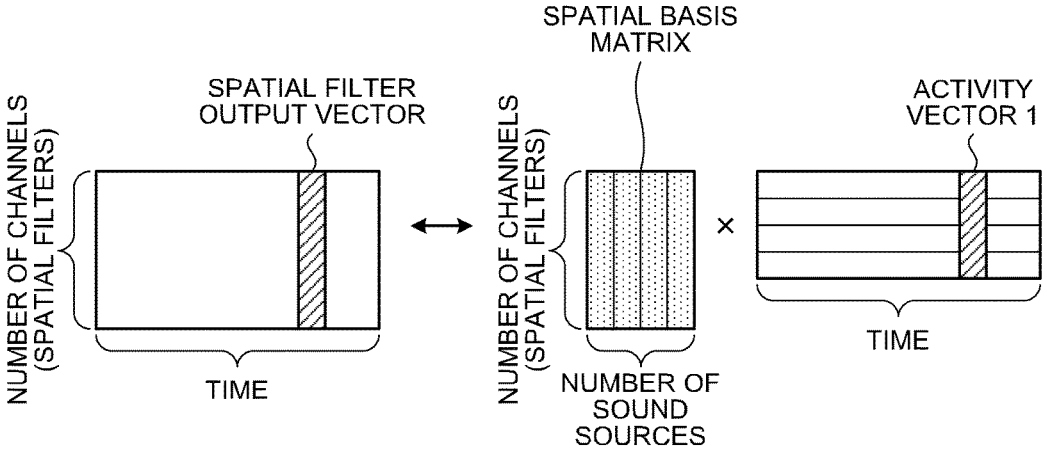
FIG. 3 is a diagram illustrating a decomposition model with NMF.

FIG. 3 is a diagram illustrating a decomposition model with NMF. The decomposition unit 110 decomposes the spatial filter output vector illustrated on the left side into the spatial basis matrix and the activity vector 1 illustrated on the right side. The spatial filter output vector corresponds to an output signal represented by an N-dimensional vector $y_{ij}$, for example.

Sound source separation based on the fact that the power ratio is constant for each sound source is formulated by NMF as problems of sound source separation and speech enhancement when a plurality of microphones are dispersedly arranged, in M. Togami, Y. Kawaguchi, H. Kokubo and Y. Obuchi: "Acoustic echo suppressor with multichannel semi-blind non-negative matrix factorization", Proc. of APSIPA, pp. 522-525 (2010) (non-patent document), for example. Conventional methods differ from the present embodiment in that not output of a spatial filter bank but this formulation is directly applied to observe a plurality of microphones.

As described above, in order for sound sources to be decomposed as different patterns by NMF, different sound sources need to have different observation patterns. The techniques such as the non-patent document utilize the fact that PSD patterns vary from a sound source close to a particular microphone to a sound source far from any microphones, for example, by arranging the microphones apart from one another. Specifically, the techniques utilize the following fact: PSD of signals observed by microphones is larger as the signals are closer to the microphones, which generates such a difference in patterns that, in a PSD pattern of a sound source close to a particular microphone, the PSD of an element observed by the microphone close to thereof is larger and that of other elements is lower whereas, in a PSD pattern of a sound source far from any microphones, a difference in value between elements is relatively small. Generating such patterns requires a specific assumption about positional relation between microphones and sound sources.

By contrast, the present embodiment requires no such an assumption as described above about microphone arrangement and locations of sound sources because properly setting a spatial filter bank enables a difference in PSD pattern between the sound sources to occur even if microphones are close to one another. Varying directional characteristics between spatial filters constituting a spatial filter bank enables the difference in PSD pattern to occur.

Furthermore, appropriately adjusting the difference in PSD pattern to be large depending on locations of sound sources and microphones can improve the accuracy of estimating the sound sources in the present embodiment. For example, a linear spatial filter group used to separate sound sources by frequency domain independent component analysis is desirably used as a spatial filter bank. With such a configuration, each filter is learned to output a separate sound source as much as possible, so that the PSD pattern naturally differs for each sound source. Consequently, sound source estimation of higher quality can be expected because of the nature of the above-described NMF. A method is also possible in which a spatial filter bank is made up of a group of beam formers that are each oriented to different directions, for example. When the entire length of a microphone array used for observation is short or the number of microphones is small, however, the directivity fails to become sharp, failing to increase a difference in PSD pattern between sound sources. With the spatial filter bank based on independent component analysis, the spatial filters are configured in accordance with corresponding observation signals, enabling the difference in PSD pattern between sound sources to be increased in the microphone array even with a short entire length and a small number of microphones.

A conventional general method can be used for decomposition into nonnegative matrices $G_i$ and $S_i$ with the above-described NMF. For example, the decomposition unit 110 estimates $G_i$ and $S_i$ so that a distance d $G_iS_i$) between $Y_i$ and $G_iS_i$ is short on condition that all values of elements in $G_i$ and $S_i$ are nonnegative. For the distance d (•, •), a square error (expression (16) to be described later), the Itakura-Saito distance (expression (20) to be described later), and other measures can be used. In doing so, a method can be used for estimating $G_i$ and $S_i$ on the basis of an iteration update rule that ensures convergence on a local optimum solution.

As described above, the signal processing system according to the first embodiment can estimate sound sources more accurately independently of a variation in acoustic characteristics of a space and other factors by applying nonnegative matrix factorization to each output signal output from the corresponding filter.

Second Embodiment

A signal processing system according to a second embodiment formulates a problem of sound source separation as a problem of NTF when the amplitude or power spectrum of multichannel is viewed as third-order tensor. The second embodiment corresponds to an embodiment achieved by extending the first embodiment, which has formulated the problem as decomposition for each frequency, to a frequency direction.

Figure 4:
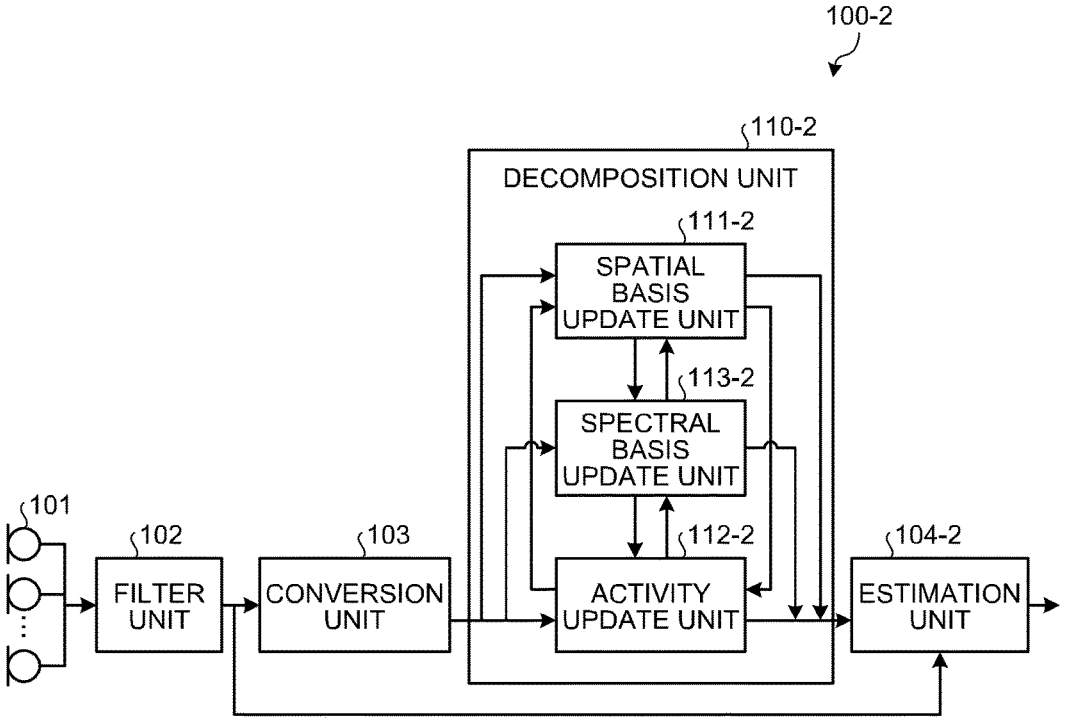
FIG. 4 is a block diagram of a signal processing system according to a second embodiment.

FIG. 4 is a block diagram illustrating an exemplary configuration of a signal processing system 100-2 according to the second embodiment. As illustrated FIG. 4, the signal processing system 100-2 includes the microphone array 101, the filter unit 102, the conversion unit 103, a decomposition unit 110-2, and an estimation unit 104-2.

In the second embodiment, functions of the decomposition unit 110-2 and the estimation unit 104-2 differ from those of the equivalent of the first embodiment. The other configurations and functions are similar to those illustrated in FIG. 1, the block diagram of the signal processing system 100 according to the first embodiment, and thus are assigned the same reference signs and description thereof is omitted.

The decomposition unit 110-2 decomposes each nonnegative signal into a spatial basis, a spectral basis matrix, and an activity vector (activity vector 3) using the NTF method. The spatial basis is a tensor that includes nonnegative three-dimensional elements, that is, K (where K is an integer of 2 or greater according to the number of sound sources) elements (the first element), N elements (the second elements), and I (where I is an integer of 2 or greater and denotes the number of frequencies) elements (the third element). The spectral basis matrix is a matrix of I rows and L columns that includes L (where L is an integer of 2 or greater) nonnegative spectral basis vectors expressed by I-dimensional column vectors. The activity vector is a nonnegative L-dimensional vector.

The activity vector (activity vector 1) of the first embodiment can be calculated by the product of the spectral basis matrix and the activity vector (activity vector 3) of the second embodiment.

The decomposition unit 110-2 includes a spatial basis update unit 111-2, an activity update unit 112-2, and a spectral basis update unit 113-2. The spatial basis update unit 111-2 updates the spatial basis with reference to its corresponding output signal, spectral basis matrix, and the activity vector. The spectral basis update unit 113-2 updates the spectral basis matrix with reference to its corresponding output signal, spatial basis, and activity vector. The activity update unit 112-2 updates the activity vector with reference to its corresponding output signal, spatial basis, and spectral basis matrix. The decomposition unit 110-2 repeats such update processing in order to improve the accuracy of decomposition.

The estimation unit 104-2 estimates a sound source signal representing the signal of a signal source on the basis of the output signal using the spatial basis, the spectral basis matrix, and the activity vector, and outputs the estimated sound source signal (estimated sound source signal).

The flow of signal processing according to the second embodiment is similar to that of the signal processing (FIG. 2) in the signal processing system 100 according to the first embodiment, and thus description thereof is omitted.

The following recites that the problem of sound source separation that has formulated by being extended to a frequency direction can be solved as an NTF problem. In expressions (12) and (13) above, decomposition is considered for each frequency, which generally involves a problem of permutation of determining which spatial basis belongs to which sound source for each frequency.

The present embodiment addresses the permutation problem by introducing a spectral basis in addition to the spatial basis. This is based on the assumption that values for power components of signals coming from the same sound source vary in synchronization with one another in all frequencies.

Because the number of sound sources is often smaller than the number of input channels, accurate separation has been conventionally difficult without any effort, such as including a penalty term in an objective function of NMF or learning a basis in advance, in the case of NMF for each frequency. As in the present embodiment, introducing a spectral basis that associates frequencies with one another adds a constraint between frequencies, enabling accurate separation without such efforts as described above.

First, decomposition as shown in expression (14) below is considered for output $\{y_{ij}\}_n$ of a spatial filter bank.

$$y_{ijn} \approx \hat{y}_{ijn} = \sum_k g_{ink} \sum_l t_{il}^{(k)} v_{lj}^{(k)} \tag{14}$$

Here, $g_{ink}$ is a coefficient (redefinition) of the spatial basis. $t^{(k)}_{il}$ is a coefficient of the spectral basis of the sound sources k. $v^{(k)}_{lj}$ is a coefficient of the activity.

These coefficients are all nonnegative real numbers. l ($1 \le l \le L$) denotes an index of the spectral basis.

Figure 5:
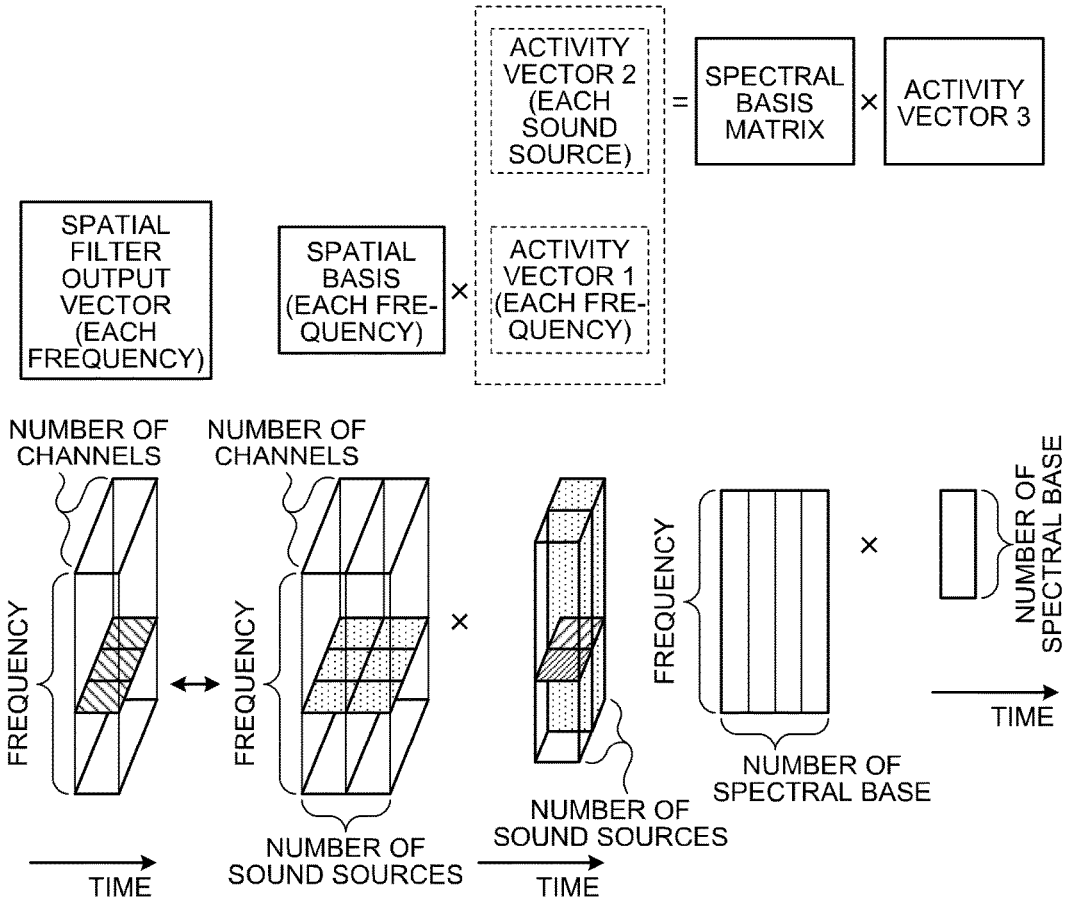
FIG. 5 is a diagram illustrating a decomposition model with NTF.

FIG. 5 is a diagram illustrating a decomposition model with NTF. The decomposition unit 110-2 decomposes the spatial filter output vector illustrated on the left side into the spatial basis, the spectral basis matrix, and the activity vector 3 illustrated on the right side. An activity vector 2 corresponds to a vector in which the elements of the activity vector 1 corresponding to the respective signal sources are expressed by I-dimensional vectors in at least part of combinations of frequency bands. The activity vector 2 is decomposed into the product of the spectral basis matrix and the activity vector 3.

Here, each sound source has L separate spectral bases. Alternatively, L may be different depending on the sound source, or sound sources may share a spectral basis.

Expression (14) shows a problem of decomposing a third-order tensor $\{y_{ijn}\}$ of a nonnegative element into tensors $\{g_{ink}\}$, $\{t^{(k)}_{il}\}$, and $\{v^{(k)}_{lj}\}$ having nonnegative values, and can be considered as a type of NTF problem.

The NTF of the present embodiment optimizes the coefficients $g_{ink}$, $t^{(k)}_{il}$, and $v^{(k)}_{lj}$ so as to decrease the distance between the observation signal $y_{ijn}$ obtained by the spatial filter bank and the estimated value $\hat{y}_{ijn}$ obtained through decomposition, similarly to NMF. That is, when the distance between x and y is d (x, y), a problem expressed by expression (15) below is solved.

$$\hat{g}_{ink}, \hat{t}_{il}^{(k)}, \tag{15}$$

-continued $$\hat{v}_{lj}^{(k)} = \underset{g_{ink}, t_{il}^{(k)}, v_{lj}^{(k)}}{\arg\min}\ d(y_{ijn}, \hat{y}_{ijn}) \text{ subject to } g_{ink} \geq 0,\ t_{il}^{(k)} \geq 0,\ v_{lj}^{(k)} \geq 0$$

This problem can use an estimation method that is based on an update rule using the auxiliary function method and ensures convergence on a local optimum solution, similarly to NMF.

A distance criterion d at this case can be selected in accordance with the purpose. When a square error (the Euclidean distance) $d_{Euc}$ represented by expression (16) below is used for the distance criterion, the update rule for each of the coefficients is represented as expressions (17), (18), and (19). Note that the $y_{ijn}$ in this case is not a power spectrum but an amplitude spectrum.

$$d_{Euc}(x, y) = |x - y|^2 \tag{16}$$

$$g_{ink} \leftarrow g_{ink} \frac{\sum_j y_{ijn} \sum_l t_{il}^{(k)} v_{lj}^{(k)}}{\sum_j \hat{y}_{ijn} \sum_l t_{il}^{(k)} v_{lj}^{(k)}} \tag{17}$$

$$t_{il}^{(k)} \leftarrow t_{il}^{(k)} \frac{\sum_j v_{lj}^{(k)} \sum_n y_{ijn} g_{ink}}{\sum_j v_{lj}^{(k)} \sum_n \hat{y}_{ijn} g_{ink}} \tag{18}$$

$$v_{lj}^{(k)} \leftarrow v_{lj}^{(k)} \frac{\sum_i t_{il}^{(k)} \sum_n y_{ijn} g_{ink}}{\sum_i t_{il}^{(k)} \sum_n \hat{y}_{ijn} g_{ink}} \tag{19}$$

When the Itakura-Saito distance $d_{IS}$ represented by expression (20) below is used for the distance criterion, the update rule for each of the coefficients is represented as expressions (21), (22), and (23). Note that the $y_{ijn}$ in this case is a power spectrum. A more general update expression with the β-divergence may be applied.

$$d_{IS}(x, y) = \frac{x}{y} - \log\frac{x}{y} - 1 \tag{20}$$

$$g_{ink} \leftarrow g_{ink} \sqrt{\frac{\sum_j y_{ijn} \hat{y}_{ijn}^{-2} \sum_l t_{il}^{(k)} v_{lj}^{(k)}}{\sum_j \hat{y}_{ijn}^{-1} \sum_l t_{il}^{(k)} v_{lj}^{(k)}}} \tag{21}$$

$$t_{il}^{(k)} \leftarrow t_{il}^{(k)} \sqrt{\frac{\sum_j v_{lj}^{(k)} \sum_n y_{ijn} \hat{y}_{ijn}^{-2} g_{ink}}{\sum_j v_{lj}^{(k)} \sum_n \hat{y}_{ijn}^{-1} g_{ink}}} \tag{22}$$

$$v_{lj}^{(k)} \leftarrow v_{lj}^{(k)} \sqrt{\frac{\sum_i t_{il}^{(k)} \sum_n y_{ijn} \hat{y}_{ijn}^{-2} g_{ink}}{\sum_i t_{il}^{(k)} \sum_n \hat{y}_{ijn}^{-1} g_{ink}}} \tag{23}$$

In order to eliminate arbitrariness between the basis and the activity, $g_{ink}$ and $t^{(k)}_{il}$ are subjected to normalization represented by expressions (24) and (25) below for each update.

$$g_{ink} \leftarrow \frac{g_{ink}}{\sum_n g_{ink}} \tag{24}$$

$$t_{il}^{(k)} \leftarrow \frac{t_{il}^{(k)}}{\sum_i t_{il}^{(k)}} \tag{25}$$

The decomposition unit 110-2 repeats performing updates in order of expressions (17), (24), (18), (25), and (19) or in order of expressions (21), (24), (22), (25), and (23) for one update.

As described above, the signal processing system according to the second embodiment can estimate sound sources more accurately independently of a variation in acoustic characteristics of a space and other factors by applying nonnegative tensor factorization to each output signal output from the corresponding filter.

Application to Speech Enhancement and Sound Source Separation

In order to perform speech enhancement or sound source separation using the coefficients obtained through NMF (first embodiment) and NTF (second embodiment), an estimation coefficient is used to obtain a gain coefficient or a separation matrix to apply it.

For the n-th filter bank output $y_{ijn}$, a gain coefficient $h_{ijnk}$ to estimate a component of the sound sources k can be calculated as shown in expression (26) below, for example.

$$h_{ijnk} = \frac{g_{ink} \sum_l t_{il}^{(k)} v_{lj}^{(k)}}{\sum_k g_{ink} \sum_l t_{il}^{(k)} v_{lj}^{(k)}} \tag{26}$$

This is used to estimate a complex spectral component $z_{ijnk}$ of the sound sources k as shown in expression (27) below on the basis of the filter bank output $y_{ijn}$ (here, a complex spectrum, not the power spectrum taking $|\cdot|^2$).

$$z_{ijnk} = h_{ijnk} \cdot y_{ijn} \tag{27}$$

In this case, any component that has already been lost in filter bank output other the n-th output cannot be restored. Alternatively, a separation matrix $H_{ij}$ in an amplitude or power domain may be considered. $H_{ij}$ is expressed by a K×N-dimensional real number.

$$\{H_{ij}\}_{kn} = \frac{g_{ink} \sum_l t_{il}^{(k)} v_{lj}^{(k)}}{\sum_k g_{ink} \sum_l t_{il}^{(k)} v_{lj}^{(k)}} \tag{28}$$

In this case, the estimated sound source complex spectrum $z_{ijk}$ of the sound sources k can be found from expression (29) below. Here, the filter bank output $y_{ijn}$ is also a complex spectrum.

$$z_{ijk} = \sum_n \{H_{ij}\}_{kn} \cdot y_{ijn} \tag{29}$$

Note that the methods of speech enhancement and sound source separation shown in expressions (27) and (29) are merely examples. For example, the square root of the right side of expressions (26) and (28) may be taken. The terms of the numerators and denominators of expressions (26) and (28) may be raised to the p-th power to take q-root of the entire right side. Methods such as a minimum mean square error (MMSE)—short time spectral amplitude (STSA) may be used.

Semi-Supervised Learning for Speech Enhancement

Because information on the sound sources k is not provided in advance in the update of the coefficients described above, which is a desired sound source cannot be directly known, similarly to the typical problem of blind sound source separation. For application to speech enhancement, assuming the number of sound sources K=2, for example, two sound sources of speech and noise are considered, but it is unknown to which sound source k=1 applies.

Here, a basis learned in advance from a clean speech is set for all spectral bases $t^{(k=1)}_{il}$ of k=1 during learning. No update is then performed for the coefficient k=1 alone in the update rule of expression (18) or (22). Thus, the signal corresponding to k=1 can be expected to be a speech signal. Because the k=1 spectral bases are not updated, the effect of reducing the calculation amount during learning can also be expected.

A basis learned in advance from a clean speech (learning data) may be set for the k=1 spectral bases as a learning initial value. In this case, the calculation amount is increased for updates during learning. When distortion is found in observed speech compared with the clean speech learned in advance, however, the learning effect can be expected of adapting the speech spectral bases to the distortion.

When the clean speech is set only for part of the k=1 spectral bases, which are not updated during learning, and the remainder of the k=1 bases and k≠1 bases are all updated, noise coming from a direction of k=1 assumed as speech can be learned as bases of speech other than k=1. Consequently, noise coming from the same direction as the k=1 sound source can also be separated from speech.

The learning initial value is not limited to the above. A value calculated from spatial arrangement of a microphone array and linear spatial filters, for example, may be set as a learning initial value.

Third Embodiment

In a third embodiment, an example of applying a signal processing system to a speech input device is described. The signal processing system of the present embodiment accurately recognizes speech using an estimated sound source signal even in an environment in which speech recognition (a technique of converting speech into text) is usually difficult, such as under noise. The system then performs control, such as using the result to operate equipment and displaying the result of speech recognition for a user.

Figure 6:
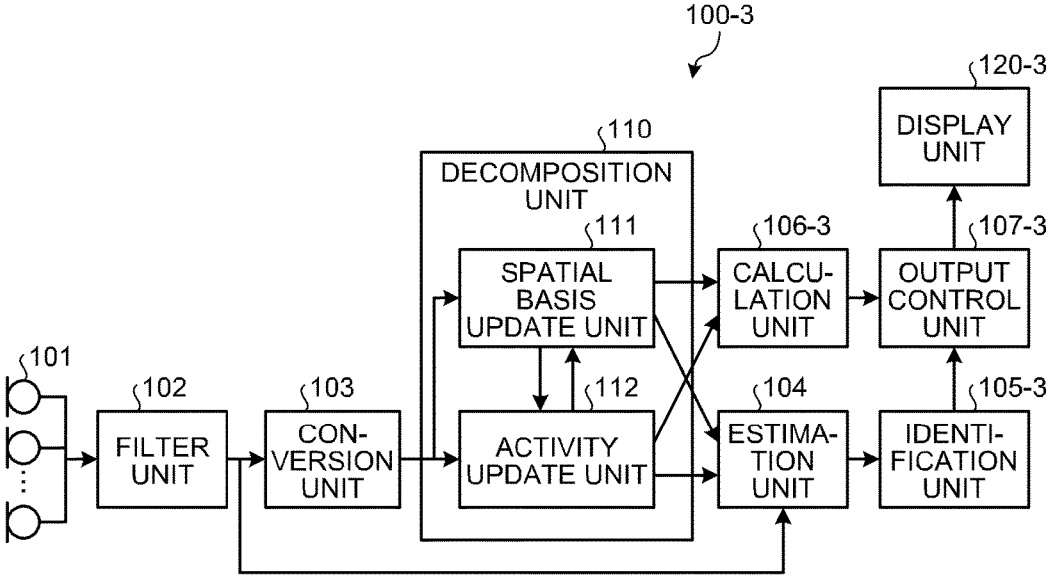
FIG. 6 is a block diagram of a signal processing system according to a third embodiment.

FIG. 6 is a block diagram illustrating an exemplary configuration of a signal processing system 100-3 according to the third embodiment. As illustrated FIG. 6, the signal processing system 100-3 includes the microphone array 101, the filter unit 102, the conversion unit 103, the decomposition unit 110, and the estimation unit 104, an identification unit 105-3, a calculation unit 106-3, an output control unit 107-3, and a display unit 120-3.

The third embodiment differs from the first embodiment in that the identification unit 105-3, the calculation unit 106-3, the output control unit 107-3, and the display unit 120-3 are added. The other configurations and functions are similar to those illustrated in FIG. 1, the block diagram of the signal processing system 100 according to the first embodiment, and thus are assigned the same reference signs and description thereof is omitted. A method of the present embodiment may be applied to the second embodiment instead of the first embodiment. That is, functions of the identification unit 105-3, the calculation unit 106-3, the output control unit 107-3, and the display unit 120-3 may be added to the second embodiment.

The identification unit 105-3 performs identification processing based on a sound source signal. For example, the identification unit 105-3 identifies a category of a signal at each time for estimated sound source signals obtained by the estimation unit 104. When the signal is an acoustic signal and the sound source is uttered speech, for example, the identification unit 105-3 identifies a phoneme for each time, transcribes contents uttered by a speaker (performs what is called speech recognition), and outputs the recognition result. In this manner, category identification includes processing of identifying the type or the contents of speech uttered by the user. Examples of the category identification include continuous speech recognition that uses the phoneme identification described above, specific keyword detection for detecting the presence of an uttered specific word, and speech detection for simply detecting the presence of uttered speech.

The calculation unit 106-3 calculates the degree of separation indicating a degree that a signal source is separated by the filter unit 102, based on a distribution of values of spatial bases (spatial basis matrix), for example. The degree of separation indicates the extent to which a sound source signal is separated from the other sound source signals.

The output control unit 107-3 performs control so as to change output of a result of identification processing performed by the identification unit 105-3, in accordance with the degree of separation. For example, the output control unit 107-3 controls display on the display unit 120-3 on the basis of the category obtained by the identification unit 105-3. In doing so, the identification unit 105-3 changes the display mode with reference to the degree of separation output from the calculation unit 106-3. For example, the identification unit 105-3 considers that, if the degree of separation is low, the estimation accuracy of the sound source signal estimated by the estimation unit 104 is also low and the result from the identification unit 105-3 is also unreliable, and displays the reason as well as a message or the like prompting re-utterance for the speaker who is the user.

The display unit 120-3 is a device such as a display that displays various types of information including images, videos, and speech signals. The output control unit 107-3 controls the contents displayed on the display unit 120-3.

A method of outputting information is not limited to display of an image, for example. A method of outputting speech may be used. In this case, the system may include a speech output unit such as a loudspeaker with the display unit 120-3, or in place of the display unit 120-3. The system may also be configured to control operation of equipment, for example, using an identification result.

As described above, the calculation unit 106-3 calculates the degree of separation indicating how well a sound source signal can be estimated and the output control unit 107-3 uses the calculated result to control output, which is a reason why the present embodiment is not merely a combination of a signal processing device and other devices.

Figure 7:
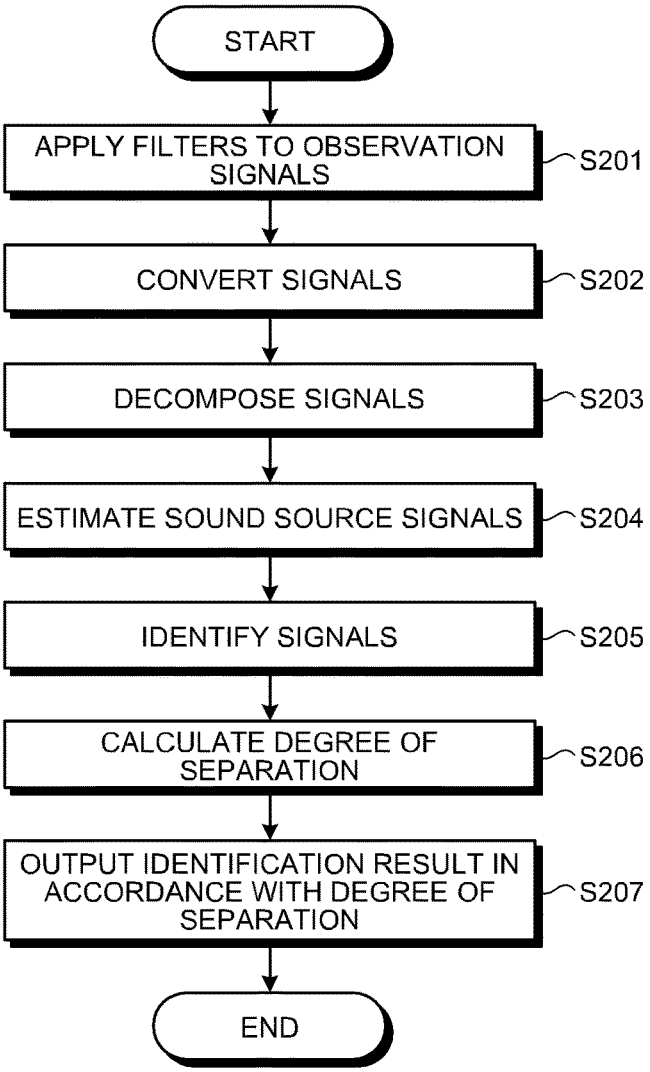
FIG. 7 is a flowchart of signal processing in the third embodiment.

The following describes signal processing performed by the signal processing system 100-3 thus configured according to the third embodiment with reference to FIG. 7. FIG. 7 is a flowchart illustrating exemplary signal processing in the third embodiment.

The signal processing from Step S201 to Step S204 is similar to the processing from Step S101 to Step S104 in the signal processing system 100 according to the first embodiment, and thus description thereof is omitted.

The identification unit 105-3 performs identification processing on the signals (estimated sound source signals) estimated by the estimation unit 104, and outputs an identification result (such as a category) (Step S205). The calculation unit 106-3 calculates the degree of separation based on the spatial basis (Step S206). The output control unit 107-3 controls output of the identification result in accordance with the calculated degree of separation (Step S207).

The following describes a specific example of how to calculate the degree of separation. The k-th column vector $g_{ik}$ of the spatial basis matrix $G_i$ in expression (13) represents a PSD output pattern in the spatial filter output of the sound sources k. If the sound sources k are sufficiently separated by the linear spatial filters of the filter unit 102, only one or a few elements of $g_{ik}$ should have large values and the remainder has small values. Consequently, whether sound sources are sufficiently separated at the filter unit 102 can be found by checking for a sparseness in the magnitude of values between elements of $g_{ik}$ (distribution of values). Furthermore, a prerequisite for the estimation unit 104 estimating sound sources more accurately is that the sound source signals are separated at the filter unit 102 to some extent. The accuracy of estimated sound source signals input to the identification unit 105-3 can therefore be found by checking a sparseness in the magnitude of the values between the elements of $g_{ik}$.

The sparseness in the magnitude of the values between the elements of $g_{ik}$ can be quantified by calculating entropy as shown in expression (30) below, for example. $g_n$ denotes the n-th element of a column vector g.

$$H(g) = -\sum_{n=1}^{N} g_n \log_2 g_n \tag{30}$$

The column vector g is assumed to be normalized as shown in expression (31) below.

$$g_n \leftarrow \frac{g_n}{\sum_{n=1}^{N} g_n} \tag{31}$$

H(g) is smaller with a larger sparseness in values, whereas H(g) is larger with a smaller sparseness. For example, a reciprocal 1/H(g) of expression (31) is assumed to be the degree of separation of the sound sources k. In practice, expression (31) is used with a cumulative sum taken also in a frequency direction i, for example.

The possibility of accurately decomposing signals at the decomposition unit 110 depends on whether the difference in PSD pattern between sound sources in the spatial filter output is sufficiently large. When the similarity, specifically, the square error, between the elements of $g_{ik}$ is small, for example, signals are unlikely to be sufficiently separated. Outputting a reciprocal of the similarity as the degree of separation is also possible.

The calculation unit 106-3 may calculate the degree of separation using the activity vector (activity vector 1) aside from the spatial basis matrix. For example, the calculation unit 106-3 may calculate entropy $H(s_{ij})$ using the activity vector $s_{ij}$ instead of the column vector $g_{ik}$ of the spatial basis matrix in expressions (30) and (31). If speech is input from a direction and the sound source is sufficiently estimated, a sparseness is generated in the value of the activity vector 1, and the value of $H(s_{ij})$ is decreased. Thus, $H(s_{ij})$ can be used as the degree of separation similarly to H(g).

Use Cases of Signal Processing Systems

Actual use cases of the signal processing systems described above are described.

Case 1: Meeting Transcription System

As a use case, a meeting transcription system is considered that is set up in a meeting room during a meeting and transcribes utterance contents of the meeting. The system includes one of the signal processing systems of the above embodiments, and is set up in the center of a meeting table in the meeting room, for example. A plurality of microphones provided to a main unit observe speech signals coming from a plurality of speakers, and output estimated sound source signals estimated for each speaker. A speech recognition device (the identification unit 105-3) recognizes the estimated sound source signals output for each speaker, and converts utterance contents of each speaker into characters. The transcribed contents can be utilized later to review the details of the meeting.

In speech recognition in which speech recorded using a microphone set up in a location away from a speaker, the influence of speech of other speakers, reverberations in a room, ambient noise, and self-noise caused by an electric circuit connected to the microphone reduces the accuracy of transcribing the speech correctly. Thus, an estimation device for estimating sound source signals is required to eliminate the influence. With the signal processing systems of the above embodiments, speech signals from each speaker can be estimated more accurately than the conventional methods, improving the accuracy of speech recognition.

In the signal processing systems of the above embodiments, because arrangement of microphones does not need to be known in advance, the microphones may be moved individually. For example, locating some microphones near meeting participants can further improve the accuracy of speech recognition. Additionally, flexible operation is possible. The location of the microphones may be changed in each meeting, for example.

With a mechanism using the calculation unit 106-3, the signal processing system itself can determine that the user's speech is not sufficiently estimated. With time recorded with meeting speech, a user of transcription and an assistant of the system transcription can listen to the meeting speech corresponding to the time again so that an error in recognition of transcribed text can be amended more quickly than a case of listening to the entire speech again.

When speech of a specific speaker is not sufficiently estimated continuously, in particular, the potential problems are that the location of a microphone is away from the user and the directivity of a microphone is not directed to the user. In such a case, the meeting participant can be notified by the system that utterance has not been caught properly and prompted to relocate the microphone by locating the microphone by the participant or directing the microphone to the participant.

Case 2: Speech Response System

As another use case, a speech response system under noise is considered. The speech response system receives a question or a request from a user by speech, understands the content, and accesses a database, for example, in order to present a response desired by the user. If the system is installed in a public space such as a station and a store, it cannot catch a user's speech correctly in some cases. For this reason, the speech input device of the above embodiment is applied to the speech response system.

Similarly to the use case of the meeting transcription system described above, user's speech of higher quality, that is speech with noise suppressed more appropriately, can be obtained with the above embodiment. Thus, the speech response system can provide the user with a more appropriate response than conventional systems.

With a mechanism using the calculation unit 106-3, the signal processing system itself can determine that the user's speech is not sufficiently estimated. In such a case, the user can be notified that utterance given by the user has not been caught properly and prompted to utter again.

Consequently, the mechanism can prevent the system from mistakenly catching and understanding a question of the user and responding improperly.

As described above, according to the first to the third embodiments, sound sources can be estimated more accurately independently of a variation in acoustic characteristics of a space and other factors.

Figure 8:
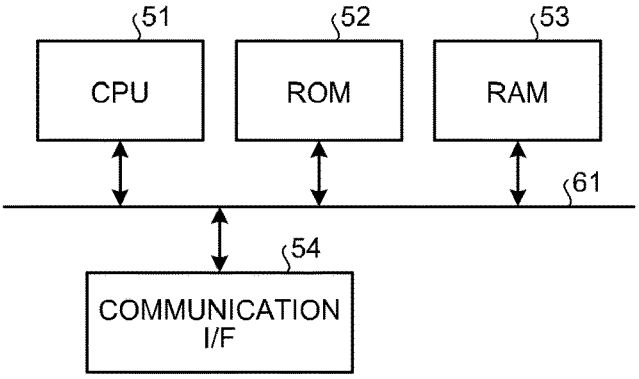
FIG. 8 is a hardware configuration diagram of the signal processing systems according to the first to the third embodiments.

The following describes the hardware configuration of the signal processing systems according to the first to the third embodiments with reference to FIG. 8. FIG. 8 is an explanatory diagram illustrating a hardware configuration example of the signal processing systems according to the first to the third embodiments.

The signal processing systems according to the first to the third embodiments include a control unit such as a central processing unit (CPU) 51, a storage device such as a read only memory (ROM) 52 and a random access memory (RAM) 53, a communication I/F 54 connected to a network for communications, and a bus 61 for connecting the units.

A computer program to be executed on the signal processing systems according to the first to the third embodiments is preinstalled and provided on the ROM 52, for example.

A computer program to be executed on the signal processing systems according to the first to the third embodiments may be recorded and provided as an installable or executable file on a computer-readable recording medium such as a compact disc read only memory (CD-ROM), a flexible disc (FD), a compact disc recordable (CD-R), and a digital versatile disc (DVD); and can be provided as a computer program product.

Furthermore, a computer program to be executed on the signal processing systems according to the first to the third embodiments may be stored on a computer connected to a network such as the Internet to be provided by being downloaded via the network. A computer program to be executed on the signal processing systems according to the first to the third embodiments may be provided or distributed via a network such as the Internet.

A computer program to be executed on the signal processing systems according to the first to the third embodiments can cause a computer to function as the units of the signal processing systems described above. This computer can be executed by the CPU 51 reading a computer program from a computer-readable storage medium to be loaded on a main memory.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A signal processing system comprising:

a filter configured to apply, to a plurality of time series input signals, N filters, N being an integer of 2 or greater, wherein each filter has different spatial characteristics from each other, and wherein the N filters are estimated by an independent component analysis of the input signals to output N output signals;

a converter, implemented in computer hardware, configured to convert the N output signals into nonnegative signals each having a nonnegative value;

a decomposer, implemented in computer hardware, configured to decompose the nonnegative signals into a spatial basis, a spectral basis matrix, and an activity vector, the spatial basis comprising nonnegative three-dimensional elements comprising K first elements, N second elements, and I third elements, K being an integer of 2 or greater according to a number of signal sources, I being an integer of 2 or greater and denoting a number of frequencies, the spectral basis matrix comprising a matrix of I rows and L columns that comprises L nonnegative spectral basis vectors expressed by I-dimensional column vectors, L being an integer of 2 or greater, the activity vector comprising a nonnegative L-dimensional vector; and an estimating processor, implemented in computer hardware, configured to estimate sound source signals representing signals of the signal sources based at least in part on the N output signals using the spatial basis, the spectral basis matrix, and the activity vector.

2. The signal processing system according to claim 1, wherein the decomposer comprises:

a spatial basis updating processor configured to update the spatial basis with reference to the N output signals, the spectral basis matrix, and the activity vector;

a spectral basis updating processor configured to update the spectral basis matrix with reference to the N output signals, the spatial basis, and the activity vector; and an activity updating processor configured to update the activity vector with reference to the N output signals, the spatial basis, and the spectral basis matrix.

3. The signal processing system according to claim 2, wherein the decomposer updates the spatial basis, the spectral basis matrix, and the activity vector so that a distance between a product of the spatial basis, the spectral basis matrix, and the activity vector and the N output signals is shorter than a distance before the update.

4. The signal processing system according to claim 3, wherein the distance is an Itakura-Saito distance or a Euclidean distance.

5. The signal processing system according to claim 2, wherein the decomposition unit updates a value calculated from spatial arrangement of a detector, implemented in computer hardware, configured to detect the input signals and the filters as an initial value of the spatial basis.

6. The signal processing system according to claim 2, wherein the decomposer updates a value learned in advance from learning data as an initial value of the spectral basis vector.

7. The signal processing system according to claim 1, wherein the converter converts each of the N output signals into the nonnegative signal that is an absolute value of each of the N output signals or a square of the absolute value of each of the N output signals.

8. The signal processing system according to claim 1, further comprising:

an identifying processor, implemented in computer hardware, configured to perform identification processing based at least in part on the sound source signals;

a calculator, implemented in computer hardware, configured to calculate a degree of separation indicating a degree that signal sources are separated by the filters, based at least in part on the spatial basis; and an output controller, implemented in computer hardware, configured to control an output of a result of the identification processing in accordance with the degree of separation.

9. A signal processing method comprising:

applying, to a plurality of time series input signals, N filters, N being an integer of 2 or greater, wherein each filter has different spatial characteristics from each other and wherein the N filters are estimated by an independent component analysis of the input signals to output N output signals;

converting the N output signals into nonnegative signals each having a nonnegative value;

decomposing the nonnegative signals into a spatial basis, a spectral basis matrix, and an activity vector, the spatial basis comprising nonnegative three-dimensional elements comprising K first elements, N second elements, and I third elements, K being an integer of 2 or greater according to a number of signal sources, I being an integer of 2 or greater and denoting a number of frequencies, the spectral basis matrix comprising a matrix of I rows and L columns that comprises L nonnegative spectral basis vectors expressed by I-dimensional column vectors, L being an integer of 2 or greater, the activity vector comprising a nonnegative L-dimensional vector; and estimating sound source signals representing signals of the signal sources based at least in part on the N output signals using the spatial basis, the spectral basis matrix, and the activity vector.

10. A computer program product comprising a non-transitory computer readable medium comprising programmed instructions, wherein the instructions, when executed by a computer, cause the computer to perform:

applying, to a plurality of time series input signals, N filters, N being an integer of 2 or greater, wherein each filter has different spatial characteristics from each other, and wherein the N filters are estimated by an independent component analysis of the input signals to output N output signals;

converting the N output signals into nonnegative signals each having a nonnegative value;

decomposing the nonnegative signals into a spatial basis, a spectral basis matrix, and an activity vector, the spatial basis comprising nonnegative three-dimensional elements comprising K first elements, N second elements, and I third elements, K being an integer of 2 or greater according to a number of signal sources, I being an integer of 2 or greater and denoting a number of frequencies, the spectral basis matrix comprising a matrix of I rows and L columns that comprises L nonnegative spectral basis vectors expressed by I-dimensional column vectors, L being an integer of 2 or greater, the activity vector comprising a nonnegative L-dimensional vector; and estimating sound source signals representing signals of the signal sources based at least in part on the N output signals using the spatial basis, the spectral basis matrix, and the activity vector.

* * * * *